United States Patent [19]

Mikoshiba et al.

[11] Patent Number: 4,461,978

[45] Date of Patent: Jul. 24, 1984

[54] METHOD OF DRIVING GAS DISCHARGE LIGHT-EMITTING DEVICES

[75] Inventors: Shigeo Mikoshiba, Nishitama; Shinichi Shinada, Kokubunji; Shoji Shirai, Koganei, all of Japan

[73] Assignee: Hitachi, Ltd., Tokyo, Japan

[21] Appl. No.: 398,706

[22] Filed: Jul. 15, 1982

[30] Foreign Application Priority Data

Jul. 29, 1981 [JP] Japan ..... 56-117775

[51] Int. Cl.[3] ..... G09F 9/00

[52] U.S. Cl. ..... 315/169.4; 340/781

[58] Field of Search ..... 315/169.4; 340/781

[56] References Cited

U.S. PATENT DOCUMENTS

| | | | |
|---|---|---|---|
| 3,654,388 | 4/1972 | Slottow et al. | 315/169.4 |
| 3,842,314 | 10/1974 | Iwakawa et al. | 315/169.4 |
| 4,063,131 | 12/1977 | Miller | 315/169.4 |
| 4,253,044 | 2/1981 | Smith | 315/169.4 |

*Primary Examiner*—Harold Dixon

*Attorney, Agent, or Firm*—Antonelli, Terry & Wands

[57] ABSTRACT

A method of driving a gas discharge light-emitting device is disclosed which utilizes Townsend emission occurring transiently when discharge is started by applying power to a gas discharge light-emitting device so as to cause discharge and stopping the application of the power approximately when the ratio of radiation output of the discharge to the charged power starts decreasing.

10 Claims, 21 Drawing Figures

METHOD OF DRIVING GAS DISCHARGE LIGHT-EMITTING DEVICES

BACKGROUND OF THE INVENTION

This invention relates to a method of driving light-emitting devices which make use of radiation such as visible light or vacuum ultraviolet light generated by gas discharge for displaying characters, figures and the like or for illumination.

A large number of light-emitting devices have been known in the past which use visible light or vacuum ultraviolet light generated by gas discharges, either directly or through excitation of phosphors, for the purpose of display, illumination or the like.

As an example of the prior art, a flat gas discharge display panel using d.c. gas discharge can be mentioned. FIG. 1 is an exploded perspective view of a panel analogous to one disclosed in reference No. 1, J. H. J. Lorteije & G. H. F. de Vries, "A two-electrode-system d.c. gas-discharge panel", 1974 Conference On Display Devices and Systems, p.p. 116–118. In the drawing, reference numeral 1 represents an insulating base plate; 2 are parallel cathodes disposed on the base plate; 3 is a spacer; 4 are through-holes bored in the spacer; 5 is phosphor applied to the inner walls of the through-holes; 6 are parallel anodes disposed perpendicular to the cathodes 2; and 7 is a transparent face plate. The through-hole 4 serves as the discharge space and has a suitable gas sealed in it. A part each of the cathodes 2 and anodes 6 is exposed to the throughhole 4, forming a pair of discharge electrodes.

In other words, a discharge tube is defined by each through-hole and pair of discharge electrodes confronting each other across the through-hole. Accordingly, the panel shown in FIG. 1 is a matrix type panel in which the discharge tubes are arranged in a $3\times4$ matrix. If gas which generates vacuum ultraviolet light, such as Xe, is selected as the gas to be sealed inside, the vacuum ultraviolet light excites the phosphor 5, generating visible light.

A variety of methods for driving the panel shown in FIG. 1 are known. The method of the reference No. 1 applies a d.c. voltage between the electrodes. In a reference No. 2, i.e., G. E. Holz, "Pulsed Gas Discharge Display with Memory", Society for Information Display, Digest of Technical Papers, pp. 36–37, 1972, a pulse voltage having a width of 1.5 μs and a period of 50 μs, for example, is applied between the anode and cathode. Similar methods of applying the pulse voltage are also disclosed in the following references Nos. 3 through 5:

Reference No. 3

M. F. Schiekel and H. Sussenbach, "DC Pulsed Multicolor Plasma Display", Society for Information Display, Digest of Technical Papers, pp. 148–149, 1980;

Reference No. 4

Y. Okamoto and M. Mizushima, "A Positive-Column Discharge Memory Panel without Current-Limiting Resistors for Color Display", IEEE Trans on Electron Devices, vol. ED-22, pp. 1778–1783, 1980;

Reference No. 5

B. T. Barnes, "The Dynamic Characteristics of a Low Pressure Discharge", Phys. Rev. vol. 86, No. 3, pp. 351–358, 1952.

To panels having dielectric covers on the cathode 2 and the anode 6 of FIG. 1, a driving method of applying a.c. voltage across the electrodes is known from reference No. 6, H. J. Hoehn, "A 60 line-per-inch Plasma Display Panel", IEEE Trans. Electron Devices, vol. ED-18, pp. 659–663, 1971.

The abovementioned panels utilize the radiation from the negative glow or positive column of the d.c. or a.c. gas discharges. The problem common to these panels is that their luminous efficacy is low. Though varying to some extents depending upon the emitted colors, the efficacy of green, which shows the highest efficacy, is at most about 1 lm/W. For high luminance display, therefore, the input power is increased which raises the panel temperature, so that the panels crack due to thermal strain.

Examinations of a color television display element using the gas discharge panel have long been carried out, as disclosed, for example, in the reference No. 7, S. Mikoshiba, S. Shinada, H. Takano and M. Fukushima, "A Positive Column Discharge Memory Panel for Color TV Display", IEEE Trans. on Electron Devices, vol. ED-26, pp. 1177–1181, 1979. However, such an element has not yet been put to practical use mainly because its luminous efficacy is low. Hence, improvements in or relating to the luminous efficacy are of the utmost importance in this field of the art.

SUMMARY OF THE INVENTION

The present invention proposes a novel method of driving light-emitting devices which utilize radiation generated from gas discharge, e.g. gas discharge display plnel or the like, and is directed to improve the luminous efficacy of the light-emitting device by use of such a driving method.

The present invention realizes high efficacy light emission of the light-emitting devices by utilizing radiation generated transiently at the start of discharge, i.e., Townsend discharge.

The term "Townsend discharge" is defined as "a first stage of low pressure, self-sustaining discharge accompanied by ionization in an electric field" and represents a discharge mode in the prestage of glow discharge which takes place immediately after the application of a voltage to a discharge tube. The breakdown phenomenon occurring at this time is governed by a Townsend mechanism. The radiation occurring along with this Townsend discharge will be hereinafter referred to as "Townsend emission". The present invention has discovered for the first time that this Townsend emission has a high luminous efficacy, and the invention was made on the basis of this finding.

BRIEF DESCRIPTION OF THE DRAWINGS

FIG. 3(*b*) is a time chart showing the driving voltage waveform;

FIG. 3(*c*) is a circuit diagram showing an example of the driving circuit;

FIG. 5(*b*) is a time chart of its driving voltage waveform;

DESCRIPTION OF THE PREFERRED EMBODIMENTS

First, the luminous characteristics of gas discharge will be explained.

Figure 1:
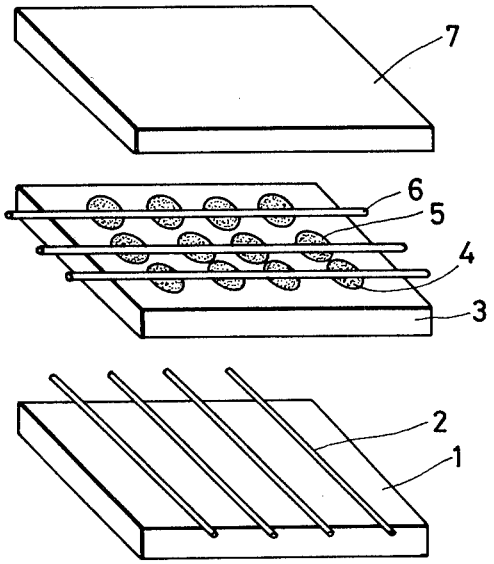
FIG. 1 PRIOR ART
FIG. 1 is an exploded perspective view showing the construction of the conventional gas discharge display panel.
Figures 2A, 2B, 2C, 2D, 2E:
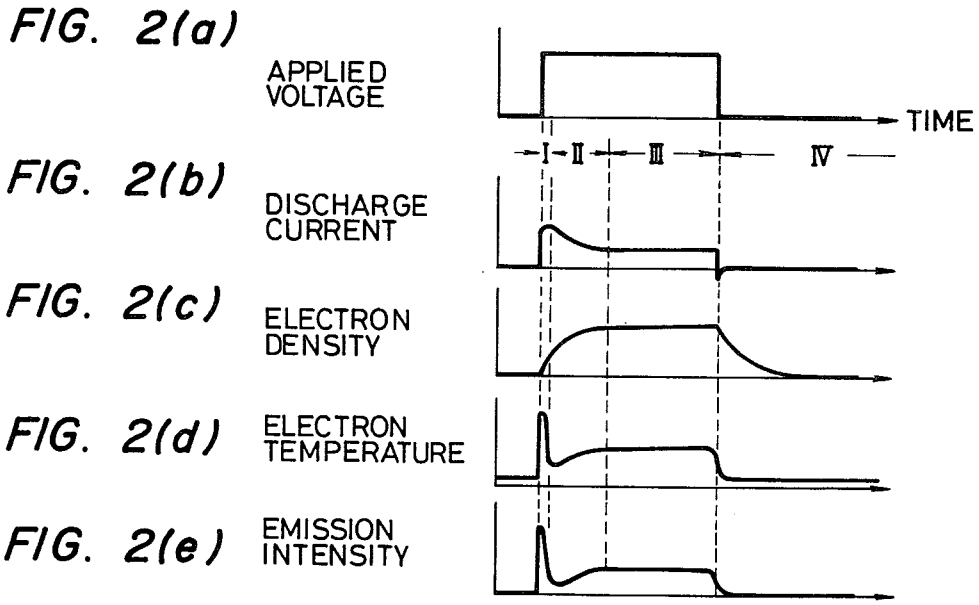
FIGS. 2(*a*) through 2(*e*) are diagrams showing the changes of applied voltage, discharge current, electron density, electron temperature and emission intensity, respectively.

FIG. 2 shows the changes of various variables when a gas consisting principally of Xe is sealed in the discharge cell shown in FIG. 1, for example, and a pulse voltage is applied to the electrodes. It will be assumed that the gap between the discharge electrodes in the discharge cell is sufficiently large and the positive column is developed under the steady state. In FIG. 2, (a) represents the voltage applied to the discharge cell and (b) represents the discharge current. (c), (d) and (e) represent the electron density, electron temperature and emission intensity at the position at which the positive column occurs, respectively. Though not shown, the strength of the axial electric field changes similar to the electron temperature.

Upon application of the voltage, a spike current flows through the discharge cell. (This period will be referred to as the "period I".) Along with this current, both electron temperature and emission intensity exhibit sharp peaks, respectively. In this period I, both Townsend discharge and Townsend emission occur. The current thereafter decreases gradually (period II). In this period II, both electron temperature and emission intensity first drop and then increase gradually towards the steady values. The electron density increases in both periods I and II. Period III represents the steady state. When the applied voltage is cut off, the discharge current gradually reaches zero while discharging the charge of stray capacitance (period IV).

The phenomena that occur in these periods I through IV will be explained next.

Period I

A strong electric field is generated inside the discharge cell along with the application of the voltage, causing electron avalanche. Since the electron density between the electrodes is low and space-charge effect is small in the initial stage of discharge, the current increases until it reaches a value that is determined by external resistance or the like. The equivalent electron temperature at this time is high. The excitation collision cross section increases exponentially with the rise of the electron temperature so that the emission intensity is large and the luminous efficacy is also great. When the electron temperature rises excessively, however, the ionization collision cross section becomes greater and the luminous efficacy drops. As the electron density can not increase rapidly, it is low in this period, but because the strength of the axial electric field is great, the current can assume a great value. Neither a positive column nor negative glow are generated in this period. Incidentally, the current in this period I includes a current which charges the stray capacitance.

Period II

The electron density generated by the avalanche increases with the passage of time and the space-charge effect becomes greater. After a certain time delay, cathode fall, negative glow, Faraday dark space, positive column and the like are generated. Excess electrons occur at the position where the positive column is generated, immediately before the discharge reaches the steady state, so that the electron temperature drops temporarily and the radiation intensity also drops drastically.

Period III

When the discharge reaches the steady state, the electron temperature inside the positive column reaches a value sufficient to compensate for the loss due to collision or diffusion of the electron energy. This value falls between the electron temperatures of periods I and II. Accordingly, the luminous efficacy is the highest in the period I, followed by the period III and then by the period II.

From the explanation described above, it can be understood that the luminous efficacy can be improved by using only the emission in the period I (or the Townsend emission) by rendering the input power zero simultaneously when the emission intensity decreases.

Preferred embodiments of the present invention will now be described in detail.

Figure 3A:
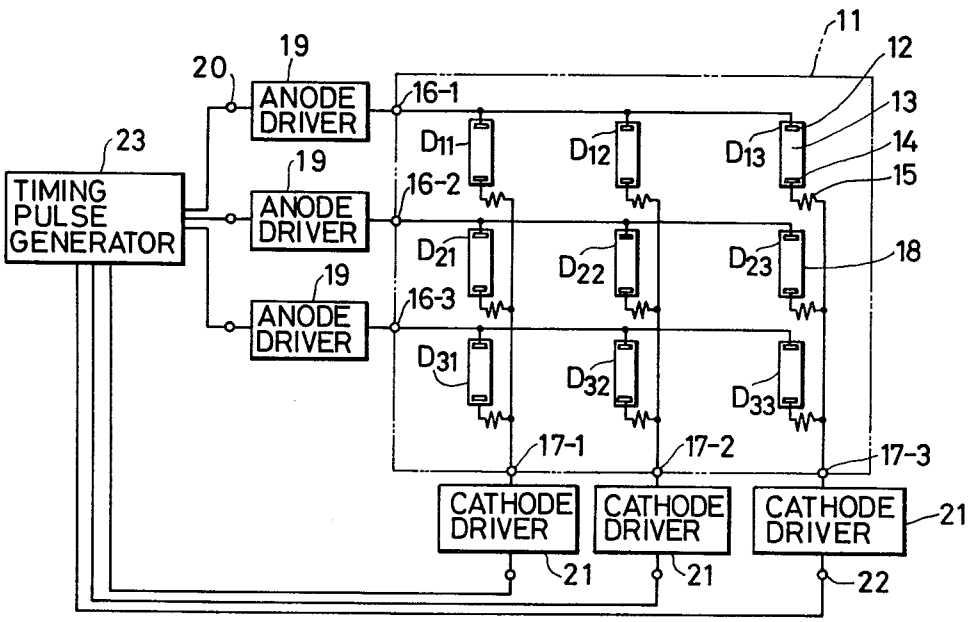
FIG. 3(*a*) is a block diagram schematically showing the construction of the apparatus for practising the driving method of the present invention.
Figure 3B:
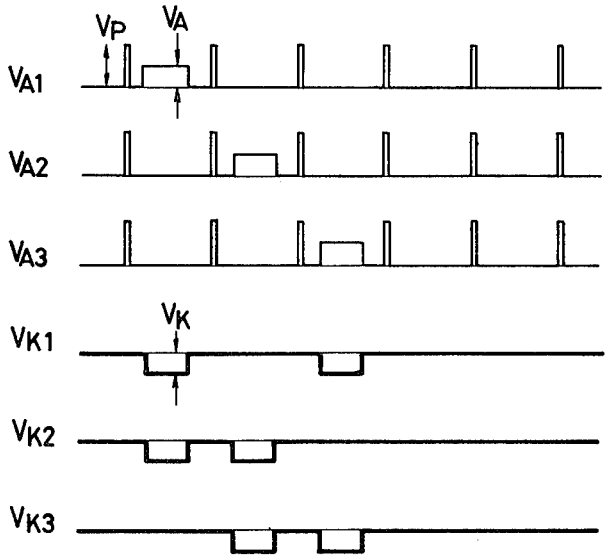
Figure 3C:
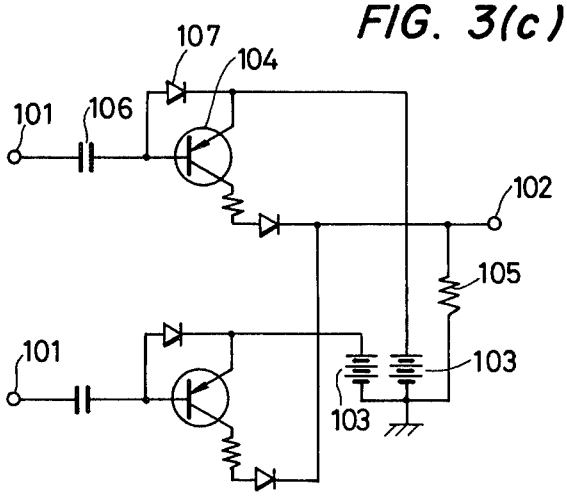

FIG. 3(*a*) is a circuit diagram showing schematically the construction of a device used for practising an embodiment of the driving method of the gas discharge panel in accordance with the present invention. In the drawing, reference numeral 11 represents a matrix type gas discharge display panel; 12 is an anode inside the discharge cell; 13 is the discharge space; 14 is a cathode; 15 is a ballast resistor; 16-1 through 16-3 are anode lead terminals; 17-1 through 17-3 are cathode lead terminals; and 18 is phosphor disposed on the wall of the discharge cell. Reference numeral 19 represents a driving circuit which generates a voltage to be applied to a group of anodes from a signal applied to an input terminal 20; 21 is a driving circuit which generates a voltage to be applied to a group of cathodes from a signal applied to an input terminal 22; and 23 is a pulse generation circuit for instructing the timing of a driving voltage to the driving circuits 19 and 21.

FIG. 3(*b*) shows the waveform of the driving voltage to be applied to the panel shown in FIG. 3(*a*). In the drawing, voltages $V_{A1}$, $V_{A2}$ and $V_{A3}$ are applied to the terminals 16-1, 16-2 and 16-3 shown in FIG. 3(*a*), respectively. Further voltages $V_{K1}$, $V_{K2}$ and $V_{K3}$ are applied to the terminals 17-1, 17-2 and 17-3 shown in FIG. 3(*a*), respectively.

A pulse $V_P$ that is periodically applied to $V_{A1}$, $V_{A2}$ and $V_{A3}$ is a narrow pulse to obtain the Townsend emission in accordance with the present invention. The size of the $V_P$ pulse is selected such that so long as the pulse is kept applied periodically, discharge lasts once it is generated by any method, and stays stopped once it is stopped by any method.

$V_A$ and $V_K$ are ignition pulses, and either one alone can not turn on the discharge because the voltage is too low. They are selected so that when combined together, they can provide a sufficiently high voltage and can turn the lamp on. Accordingly, a discharge cell to which $V_A$ and $V_K$ are simultaneously applied is turned on and the discharge thereof is thereafter maintained by the $V_P$ pulse. On the other hand, a discharge cell to which either one of $V_A$ and $V_K$ alone is applied, it not turned on and does not discharge even when the $V_P$ pulse is applied. Accordingly, if the voltage is applied with the timing shown in FIG. 3(*b*), for example, the discharge cells $D_{11}$, $D_{12}$, $D_{22}$, $D_{23}$, $D_{31}$ and $D_{33}$ are turned on while the discharge cells $D_{13}$, $D_{21}$ and $D_{32}$ are not turned on. All the discharge cells can be turned on in an arbitrary manner. The $V_P$ pulse can be stopped for a predetermined period of time, for example, in order to turn off the discharge.

The driving circuit 19 shown in FIG. 3(*a*) can be constructed such as shown in FIG. 3(*c*), for example. This circuit will be explained with reference to FIG. 6 which will be described later. In FIG. 3(*a*), the input terminal 20 consists of two terminals, for example, and is connected to 101 in FIG. 3(*c*). The anode lead 16-1, 16-2 or 16-3 in FIG. 3(*a*) is connected to 102 in FIG. 3(*c*). Two power sources 103 have the values $V_P$ and $V_A$, respectively.

Though FIG. 3(*a*) schematically illustrates the matrix type gas discharge display panel, the panel can be practically constructed in the same way as the panel shown in FIG. 1, for example. Alternatively, it may be constructed in the same way as the panel shown in FIG. 4. Still further, a single discharge tube such as shown in FIG. 5(*a*) can be used in place of the matrix type gas discharge panel.

Figure 4A:
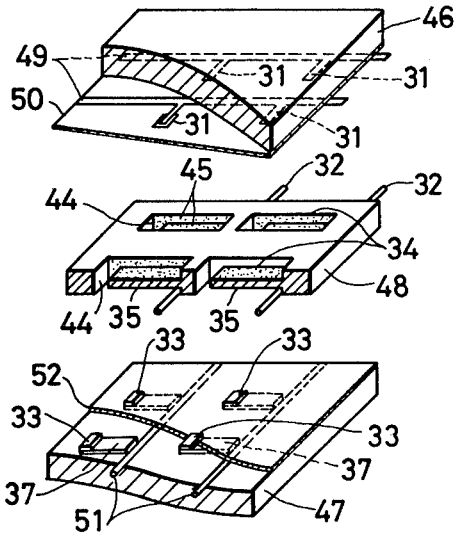
FIG. 4 shows an example of a construction of the gas discharge display panel to which the driving method of the present invention can be applied and FIG. 4(*a*) and 4(*b*) are an exploded perspective view and a sectional view of the panel, respectively.
Figure 4B:
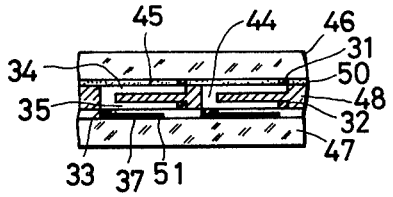

In FIGS. 4(*a*) and 4(*b*), reference numeral 31 represents a display discharge anode; 32 is an auxiliary discharge anode; 33 is a common cathode; 34 is the display discharge space; 37 is a resistor; 44 is a space connecting the two discharge spaces; 45 is a phosphor coated on the display discharge space; 46 is a transparent, insulating face plate; 47 is an insulating base plate; 48 is an insulating plate; 49 is a display discharge anode lead; 50 is display discharge anode cover glass; 51 is a cathode lead; and 52 is cathode cover glass.

A pulse voltage for generating the Townsend emission is applied across the display discharge anode 31 and the common cathode 33. High efficacy emission can be obtained within the display discharge space 34. The auxiliary discharge anode 32 and the auxiliary discharge space 35 are disposed in order to realize high speed switching of the discharge cells but are not directly related with the improvement to the luminous efficacy.

Figure 5A:
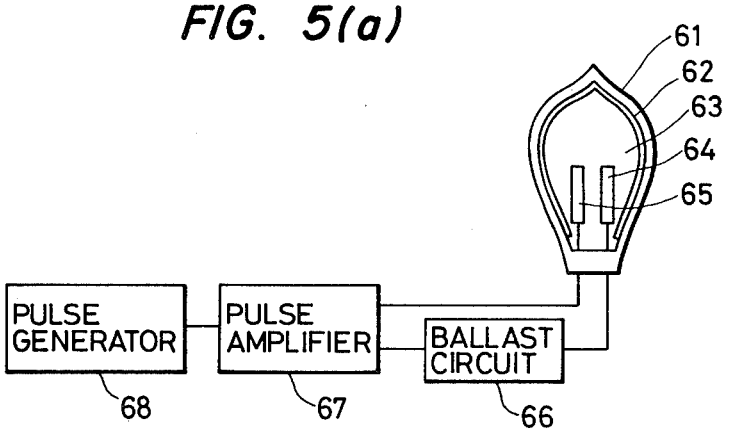
FIG. 5(*a*) shows an example of a light-emitting device using a discharge tube in accordance with the driving method of the present invention.
Figure 5B:
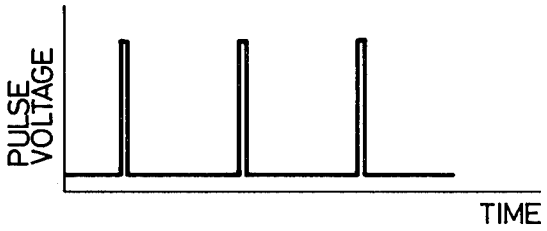

In FIG. 5(*a*), reference numeral 61 represents a transparent exterior tube; 62 is phosphor disposed on the inner surface of the exterior tube; 63 is a discharge space; 64 and 65 are electrodes; 66 is a ballast circuit; 67 is a pulse amplification circuit; and 68 is a pulse generation circuit.

The abovementioned pulse generation circuit 68 consists of a monostable flip-flop circuits of 0.2 μs and 40 μs, for example. In this case, the output voltage of the pulse amplification circuit 67 forms a pulse train having a pulse width of 0.2 μs and a pulse period of 40.2 μs, as shown in FIG. 5(*b*).

Figure 6:
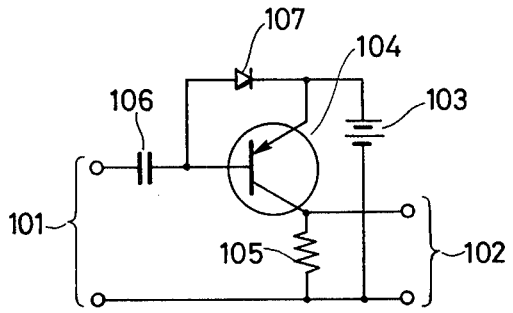
FIG. 6 is a circuit diagram showing an example of the circuit construction for generating the applied pulse in accordance with the driving method of the present invention.

The circuit shown in FIG. 6 can be used, for example as the pulse amplification circuit 67. In the drawing, when a pulse voltage of about 5 V is applied to the input terminal 101, a pulse having a width substantially equal to the input pulse width can be obtained from the output terminal 102. The voltage of the output pulse is substantially equal to the voltage of the d.c. power source 103. Reference numeral 104 represents a switching element such as a bipolar transistor or a MOS field effect transistor; 105 is a resistor; 106 is a coupling capacitor; and 107 is a diode.

When the switching element 104 in FIG. 6 is opened, the voltage between the electrodes 64 and 65 inside the discharge cell shown in FIG. 5 become zero, and no discharge occurs. Next, when the switching element 104 is short-circuited, the voltage of the power source 103 is applied across the electrodes 64 and 65. Discharge occurs when the voltage of the power source 103 is sufficiently large, Townsend emission develops inside the discharge space 63 and the cell emits the light. When the switching element 104 is again opened together with the decrease in the emission intensity, discharge stops.

Incidentally, a bias voltage may be constantly applied to the output voltage.

Figure 7:
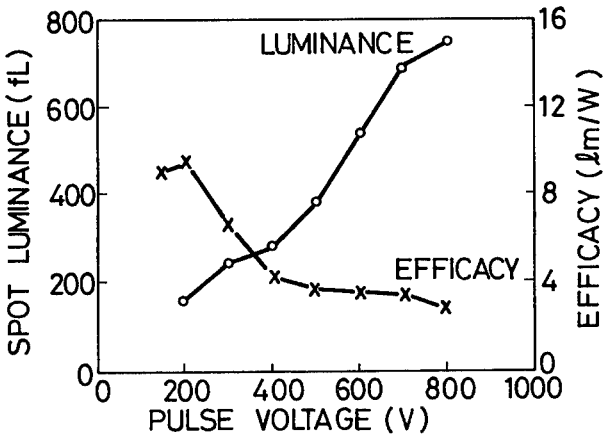
FIG. 7 shows the changes of the spot luminance of a discharge cell in green and of the efficacy with respect to the applied pulse voltage.

As a discharge tube similar to the device shown in FIG. 4, a cylindrical (prismatic, in practice) space having a length of 2.1 mm and an equivalent cross-sectional diameter of 0.7 mm is disposed, a green emitting phosphore $Zn_2SiO_4$:Mn is coated on the inner wall and xenon is sealed in the discharge tube at a pressure of 20 Torr. Visible light is observed in the radial direction and the luminous efficacy is measured by observing the visible light from the radial direction. The results are shown in FIG. 7. The pulse voltage width is 0.2 μs and the period is 40 μs. The cathode is made of barium. Discharge stops when the voltage drops below 200 V. If the voltage exceeds 1,000 V, on the other hand, a switching element having a high withstand voltage must be used as the switching element 104 in FIG. 6 and radiation noise becomes great. Accordingly, a preferred pulse voltage ranges from 200 to 1,000 V. If the switching element is constructed as an integrated circuit, the pulse voltage is preferably below 400 V and the preferred pulse voltage therefore ranges from 200 to 400 V. When the pulse voltage is 200 V and 800 V, the peak value of the discharge current is 100 μA and 400 μA, respectively, and the time average of the power consumption is about 0.1 mW and about 1.6 mW, respectively.

Figure 8:
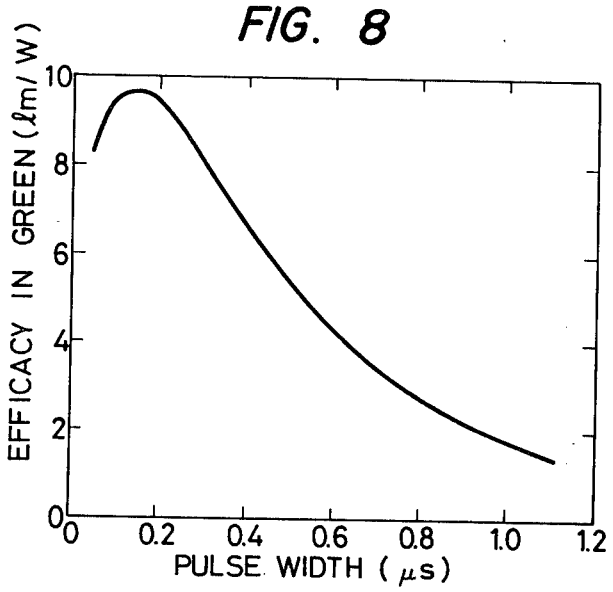
FIG. 8 shows the change of the efficacy with the pulse width.

In FIG. 8, the pulse width on the abscissa represents the width of the pulse voltage at the output terminal 102 in FIG. 6, for example. The pulse voltage is 200 V and the pulse period is 40 μs. If the width of the Townsend emission is defined as the emission width when the emission output is 50% of the peak value, the width of the Townsend emission of Xe is about 0.2 μs so that the luminous efficacy reaches a maximal value of about 10 lm/W if the pulse width is also selected to be about 0.2 μs. This value is about ten times the luminous efficacy in accordance with the conventional driving system, i.e., about 1 lm/W.

If the pulse width is further increased, the input power increases substantially proportionally to the pulse width but the radiation does not increase. Hence, the efficacy decreases substantially inversely to the pulse width. It can be appreciated from FIG. 8 that high efficacy emission can be obtained when exciting Xe or a mixed gas consisting principally of Xe if the pulse width is selected to be up to 0.5 μs, which is about thrice the width of the Townsend emission. The luminous efficacy is ½ of the maximal value when the pulse width is 0.5 μs. When a pulse of a 1 μs width is used, the luminous efficacy drops down to about 1/5 of the maximal value.

When the pulse width is 0.05 μs or below which is ¼ of the Townsend emission width, the proportion of the stray capacitance charging current to the total current increases and the lowering of the luminous efficacy becomes further remarkable. It is not preferred, either, to drive a matrix type panel by a pulse of a width of 0.05 μs or below, from the viewpoint of circuit construction because of the floating capacitance or the like. Accordingly, it is preferred that the pulse width of the applied voltage be up to thrice the width of the Townsend emission. Further preferably, the pulse width of the applied voltage is from ¼ to 1.5 times the width of the Townsend emission, that is, from 0.05 μs to 0.3 μs for the Townsend emission using Xe. In this case, the luminous efficacy does not drop below 80% of the maximal value. The optimal pulse width of the applied voltage depends upon the waveform of the Townsend emission. In any case, it is most preferred that the input voltage is made zero when the ratio of the emission output to the electric input starts to lower, whatever the waveform may be.

The luminous efficacy can be improved in accordance with the present invention because the electron temperature rises suitably. Various methods are available to accomplish this object. For example, the electron temperature may be raised by superposing a pulse current on a steady current so as to rapidly increase the current. In other words, in FIG. 3, a bias voltage, which may be greater or smaller than the maintenance voltage of the discharge, can be applied in advance to all the discharge cells. However, the degree of improvement in the efficacy varies. Incidentally, the driving voltage generation circuits 19 and 21 in FIG. 3 may be either a voltage source or a current source.

If the applied pulse voltage is too small, the electric field becomes weaker during the Townsend discharge and the efficacy drops. If the over-voltage of the applied voltage pulse is small, the time jitter of the discharge current becomes greater. In such a case, the pulse width to be applied in practice must be a value obtained by adding this time jitter to the value obtained from FIG. 8. The time jitter of the discharge current varies from cell to cell when a large number of cells are driven. If the driving pulse voltage width is expanded in order to reliably turn on all the cells, the efficacy of those cells which have short time jitter of the discharge current drops as can be understood from FIG. 8. To minimize the drop of efficacy, it is important to reduce variance of the time jitter of the discharge current by sufficiently increasing the over-voltage. The term "over-voltage" hereby means the difference between the applied pulse voltage and a d.c. breakdown voltage of the discharge. Under the abovementioned experimental condition, for example, the time jitter can be made sufficiently small and its variance can also be reduced. The preferred over-voltage value ranges from 100 to 400 V.

Incidentally, the ballast resistor 15 shown in FIG. 3(*a*) is not always necessary. However, it is not possible at times to make the driving pulse width sufficiently small for the abovementioned reason when a large number of cells are driven. In this case, the current of those cells which have the short time jitter of the discharge current rises up to a value that is determined by an external resistor and the like. In such a case, the resistor 15 can reduce the drop of efficacy. In the abovementioned experiment, the resistor 15 has resistance of about 2MΩ.

In the foregoing explanation, the pulse applied to the discharge cells has a single polarity, but the polarity may be changed to the positive or negative. In this case, the electrodes need not be exposed to the discharge surface and may be insulated by dielectric layers.

When Townsend emission is utilized, the luminous flux and spot luminance are likely to become insufficient if emission is effected by a single pulse alone. In such a case, a plurality of Townsend emission light may be generated by applying a plurality of pulses in the time sequence to the discharge cells.

Figure 9:
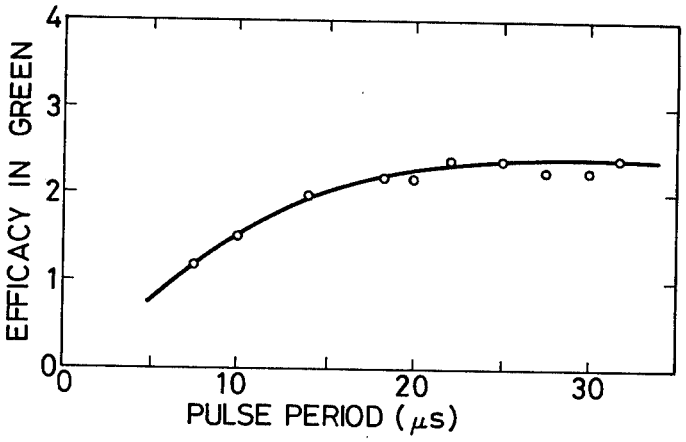
FIG. 9 shows the change of the luminous efficacy with the applied pulse period.

FIG. 9 shows the change in the luminous efficacy in green when the applied pulse width is kept constant but the pulse period is changed. It can be seen from FIG. 9 that the efficacy starts dropping when the pulse period becomes 15 μs or below and reaches ½ of the maximal value when the pulse period becomes 7 μs. This is because, when the pulse period becomes smaller, the residual charge and metastable atoms from the previous pulses do not decrease sufficiently at the time of the pulse application, so that a high electric field can not be applied and the electron temperature does not rise sufficiently. The pulse period need not be constant.

When this discharge emission is used for display, flickers become visible to the human eye if the pulse period exceeds 33 ms. Accordingly, the pulse period is preferably below this value. When the pulse period exceeds 100 μs, on the other hand, the voltage necessary to maintain the pulse discharge increases drastically so that the luminous efficacy drops, on the contrary. For this reason, the preferred pulse period ranges from 7 to 100 μs.

Figure 10:
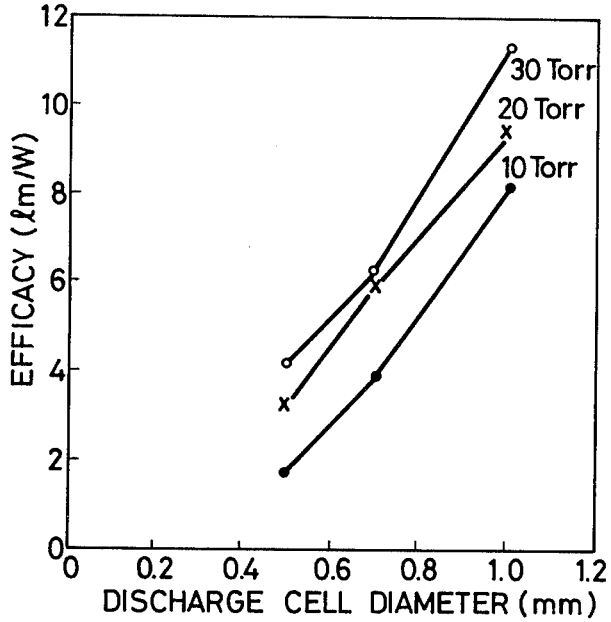
FIGS. 10 and 11 are diagrams showing the change of the luminous efficacy with the diameter and length of the discharge cell, respectively.

FIG. 10 shows the relation between the diameter of the discharge cell and the luminous efficacy in green when Xe is sealed at the pressure of 10, 20 or 30 Torr in the discharge cell having a length of 3 mm and a 500 V pulse voltage having a pulse width of 0.2 μs and period of 40 μs is applied to the discharge cell. The luminous efficacy is substantially proportional to the 3/2 power of the cell diameter. The higher the Xe pressure, the higher the efficacy, but the discharge maintenance voltage also increases.

Figure 11:
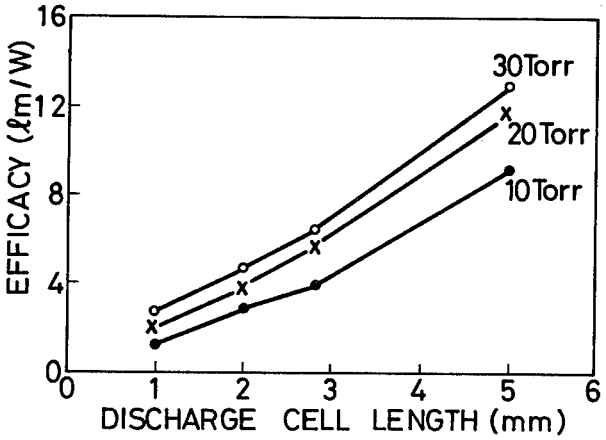

FIG. 11 shows the relation between the length of the discharge cell and the luminous efficacy in green when Xe is sealed at the pressure of 10, 20 or 30 Torrs in the discharge cell having a length of 3 mm and a 500 V pulse voltage having a pulse width of 0.2 μs and a period of 40 μs is applied to the cell. The spot luminance is substantially proportional to the cell diameter.

Figure 12:
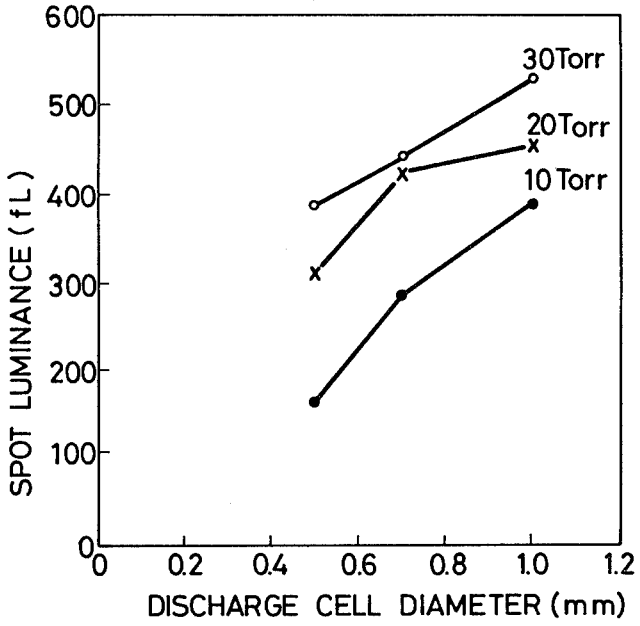
FIGS. 12 and 13 are diagrams showing the change of the spot luminance in green with the diameter and length of the discharge cell, respectively.

FIG. 12 shows the relation between the discharge tube diameter and the spot luminance in green for a discharge tube 3 mm long and filled with Xe when a 500 V pulse with a width of 0.2 μs and a period of 40 μs is applied. The spot luminance is almost proportional to the tube diameter.

Figure 13:
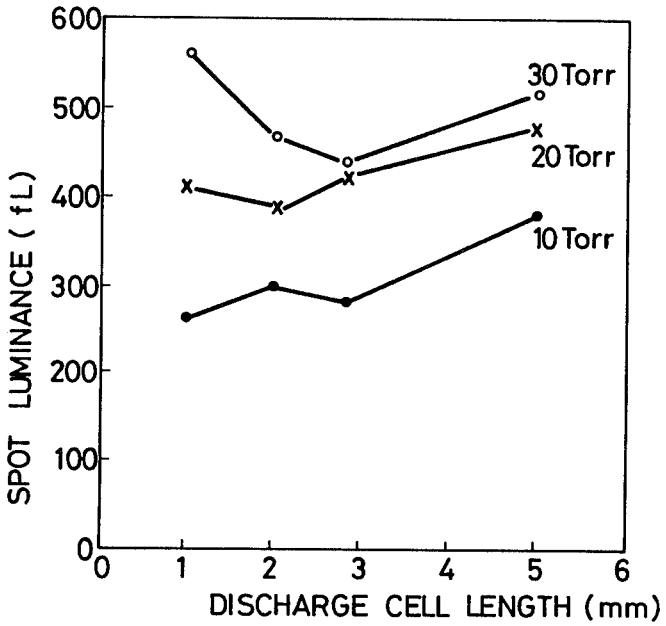

FIG. 13 shows the relation between the cell length and the spot luminance in green when Xe is sealed in a discharge cell 0.7 m in diameter and a 500 V pulse voltage having a width of 0.2 μs and period of 40 μs is applied to the cell. The spot luminance does not depend much upon the cell length.

In accordance with the display system of the present invention which uses the Townsend emission, it is possible to obtain high luminous efficacy and this emission also provides high luminance. For example, the values of the spot luminance shown in FIGS. 7, 12 and 13 can be obtained by a driving pulse having a pulse width of 0.2 μs and period of 40 μs at a driving duty ratio of 1/200. If the cell having a 0.7 mm diameter and a 3 mm length and a voltage of 800 V are selected, the spot luminance in green is about 800 fL. When a color television picture is displayed using such a display panel, an area luminance in white of 200 fL can be obtained while the area utilization ratio of the discharge cell is 50% and the drop of luminance due to the difference in the spectral reponse of eyes between white and green is ½. If the period and the driving duty ratio are changed to 10 μs and 1/50, respectively, for example, the spot luminance in green and the area luminance in white become about 4 times the abovementioned value, i.e., about 3,200 fL and about 800 fL, respectively, thereby making it possible to display with extremely high luminance. Incidentally, in the case of the d.c. positive column discharge, an area luminance in white of only about 200 fL can be obtained even if the driving duty ratio is made approximately 1.

In the foregoing description, the gas to be sealed in the discharge cell is Xe by way of example, but He, Ne, Ar, Kr, Hg and the like or a mixture of these gases can provide Townsend emission having high efficacy and high luminance. The discharge current density, the discharge maintenance voltage, the d.c. breakdown voltage of the discharge, the minimum discharge current and the like can be changed by suitably selecting these gases, and the luminance as well as the efficacy also vary.

Next, the difference between the present invention and the aforementioned references will be described. Since the first reference applies a d.c. voltage to the discharge cell, emission occurs mostly in the period III shown in FIG. 2 and hence, the luminous efficacy is low. In the references Nos. 2 through 4, on the other hand, a synchronous pulse voltage is applied to the discharge cell for the purpose of providing each discharge cell with the memory function but not for improving the luminous efficacy. Accordingly, the pulse width is selected so that it is too small to generate a new discharge inside a discharge cell but is sufficiently large to maintain a discharge once one has been generated. Hence, the pulse width is a function of the pulse period and the pulse voltage. In references Nos. 2 and 3, the pulse width is further smaller than the period in which arc discharge grows.

The pulse width used in references Nos. 2 through 4 is about 1 to about 10 μs. As is obvious from FIG. 8, therefore, high efficacy emission of the cell can not be expected. As a matter of fact, it has been reported that the cell luminous efficacy of this system is substantially equal to the luminous efficacy in period III of FIG. 2 and is only about 1/10 of the efficacy in period I.

Reference No. 6 applies an a.c. voltage to the electrodes. Since its frequency is up to 100 KHz, however, each half cycle is sufficiently longer than the length of the Townsend emission. Hence, the power is charged to the cell after the emission in the period I in FIG. 2 is completed. Accordingly, the luminous efficacy is approximate to that in the period III in FIG. 2.

Reference No. 5 discloses that when the driving current of a discharge cell sealing therein Hg and Ar is rapidly changed, sharp spikes appear in the electron temperature and in the ultraviolet intensity. However, the pulse width in this reference is not shortened to a width approximate to that in the period I shown in FIG. 2 and the current keeps flowing even after completion of the Townsend emission so that the luminous efficacy is not high.

As described in the foregoing, the present invention makes it possible to improve the luminous efficacy of the gas discharge light-emitting devices. When applied to a gas discharge type display panel, for example, the present invention increases the luminous efficacy by about 10 times that of the prior art devices.

What is claimed is:

1. In a method of driving a gas discharge light-emitting device consisting of at least a pair of electrodes, a gas charged around said electrodes and an air-tight container for holding said gas, the improvement wherein power is applied to said gas discharge light-emitting device through said electrodes so as to cause discharge, and the application of said power is terminated approximately when the ratio of radiation output of said discharge to the charged power starts decreasing.

2. The method of driving a gas discharge light-emitting diode as defined in claim 1, wherein the time width from when power is applied to when the power is no longer applied is up to three times the width of Townsend emission.

3. The method of driving a gas discharge light-emitting device as defined in claim 1 wherein the time width from when the power is applied to when the power is no longer applied is from 0.05 μs to 0.5 μs.

4. The method of driving a gas discharge light-emitting device as defined in claim 1 wherein the time width from when power is applied to when power is no longer applied is from ¼ times to 1.5 times the width of Townsend emission.

5. The method of driving a gas discharge light-emitting device as defined in claim 1 wherein the time width from when power is applied to when power is no longer applied is from 0.05 μs to 0.3 μs.

6. The method of driving a gas discharge light-emitting device as defined in any of claims 2 through 5 wherein a pulse voltage having said time width is applied as said power.

7. The method of driving a gas discharge light-emitting device as defined in claim 6 wherein said pulse voltage is from 200 V to 1,000 V.

8. The method of driving a gas discharge light-emitting device as defined in claim 6 wherein said pulse voltage is from 200 V to 400 V.

9. The method of driving a gas discharge light-emitting device as defined in claim 1 wherein the start and stop of said power are periodically repeated.

10. The method of driving a gas discharge light-emitting device as defined in claim 9 wherein the period of repetition is from 7 μs to 100 μs.

* * * * *